US007845027B2

(12) United States Patent
Er et al.

(10) Patent No.: US 7,845,027 B2
(45) Date of Patent: Dec. 7, 2010

(54) SLOW CLOSURE MECHANISM FOR TOILET COVERS

(75) Inventors: Osman Er, Istanbul (TR); Pelin Ileriye, Istanbul (TR)

(73) Assignee: Eczacibasi Yapi Gerecleri Sanayi Ve Tircaret A.S., Istanbul (TR)

( * ) Notice: Subject to any disclaimer, the term of this patent is extended or adjusted under 35 U.S.C. 154(b) by 923 days.

(21) Appl. No.: 11/575,768

(22) PCT Filed: Sep. 16, 2005

(86) PCT No.: PCT/IB2005/053049

§ 371 (c)(1), (2), (4) Date: Mar. 27, 2007

(87) PCT Pub. No.: WO2006/035338

PCT Pub. Date: Apr. 6, 2006

(65) Prior Publication Data

US 2007/0214556 A1 Sep. 20, 2007

(30) Foreign Application Priority Data

Sep. 28, 2004 (TR) ..... 2004/02481

(51) Int. Cl.
*A47K 13/12* (2006.01)

(52) U.S. Cl. ..... 4/236; 4/240; 4/248

(58) Field of Classification Search ..... 4/234, 4/236, 240, 241, 248
See application file for complete search history.

(56) References Cited

U.S. PATENT DOCUMENTS

| | | | | |
|---|---|---|---|---|
| 4,438,535 | A * | 3/1984 | Paredes | 4/234 |
| 6,182,301 | B1 * | 2/2001 | Krueger et al. | 4/248 |
| 6,453,478 | B1 * | 9/2002 | Semmler | 4/236 |
| 6,687,921 | B1 * | 2/2004 | Li | 4/236 |

* cited by examiner

*Primary Examiner*—Tuan N Nguyen
(74) *Attorney, Agent, or Firm*—Gottlieb, Rackman & Reisman P.C.

(57) ABSTRACT

The subject of the invention is a slow closure mechanism (A) for toilet covers wherein it comprises two-hinge bodies (1), two pins (2), two dampers (3) and a body cover (4). Slow closing and easy opening process of toilet covers are achieved by tightly recessing the pins (2) and dampers (3) in the hinge body (1), connecting toilet covers and body cover (4) to pin shaft (23) and damper shaft (31) in slow closure mechanism (A).

4 Claims, 5 Drawing Sheets

SLOW CLOSURE MECHANISM FOR TOILET COVERS

TECHNICAL FIELD

This invention relates to a hinge mechanism providing slow closure for toilet covers.

BACKGROUND ART

Recently, hinge mechanism on the toilet covers have been modified extremely. Conventional hinges are replaced with slowly closing damper hinges. In conventional hinges, when the cover is being closed, it is closed very quickly by gravity without slowing down. Covers are self-closed in a controlled manner after a first action is given by means of the dampers located in the hinge of toilet cover. Then, there is no need for any interference to slowly close the covers. Therefore user touches the toilet cover for a shorter time.

In the prior art, there are hinge mechanisms for slowly closing toilet cover. In principle, one of dampers controls the lower cover and the other controls the upper cover by various methods and they provide slow closure. In published patent applications Nos. DE10233733, DE10324172, different applications about the subject are described.

In published German patent application No DE10233733, there is a fixed mechanism leg and a shaft connected vertically to this foot providing slow closure through moving by friction relative to the mechanism leg. In a shaft connected to right mechanism leg, first cover is fixed to the shaft and second cover is connected to the shaft so that it could make a pivoting movement relative to the shaft. In a shaft connected to left mechanism leg, second cover is fixed to the shaft and first cover is connected to the shaft so that it could make a pivoting movement relative to the shaft. The essential disadvantage of this system is that parts providing slow closure by friction are main parts of the system and functional failure due to wearing of these parts results in a requirement to replace more than one part. In the system of the invention, slow closure function is provided by available dampers and when the parts are worn down it would be sufficient to replace the damper only.

In published German patent application No DE10324172, a slow closure mechanism obtained by using dampers is described. The essential difference of the mechanism described in DE103241172 is that numerous parts are present in DE103241172 and cost of parts and dies are high since these parts have a complex geometry.

The system of the invention is a slowly closing toilet cover mechanism obtained by using two dampers, a pin and a hinge body and a body cover.

OBJECT OF THE INVENTION

The object of the invention is to form a hinge mechanism providing controlled and slow closure of upper and lower toilet covers by means of pins and hinge body by using available dampers.

DESCRIPTION OF THE DRAWINGS

The system of the invention is illustrated in the appended figures, in which.

In figures, each part is numbered individually and corresponds to the numbers given below:

Slow closure mechanism (A)
Hinge Body (1)
Pin (2)
Damper (3)
Body Cover (4)
Sitting Surface (11)
Pin-damper housing (12)
Protrusion slot (13)
Leg (14)
Pin Protrusion (21)
Pin Channel (22)
Pin Shaft (23)
Pin Body (24)
Damper Shaft (31)
Damper Fixing Protrusion (32)
Damper Body (33)
Hole For Body Cover Screw (41)
Damper Placement Housing of Body Cover (42)
Pin Placement Housing of Body Cover (43)
Body Cover Form on the Toilet Cover (51)
Damper Housing of Cover (62)
Pin Housing of Cover (63)

Drawings of the main parts of the slow closure mechanism (A) for toilet covers of the invention are shown in FIGS. 1-4. Also, the mechanism (A) is shown before mounting in FIG. 5 and in FIG. 6 as mounted, excluding toilet covers.

Figure 1:
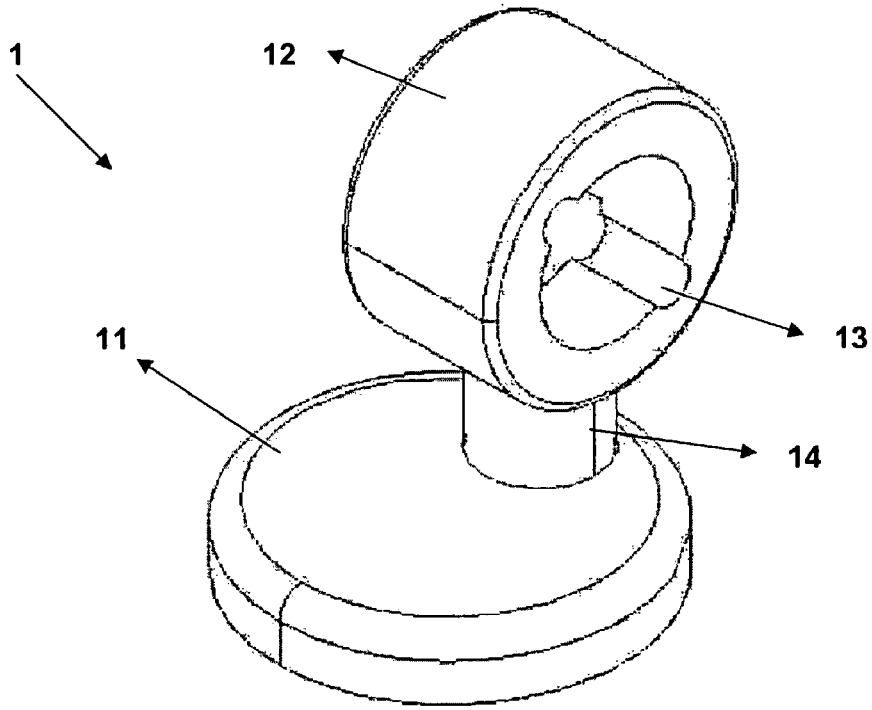
FIG. 1 is a perspective view of the hinge body.

Hinge body (1) shown in FIG. 1 is a part connecting the slow closure mechanism to the toilet and used as a housing for dampers and pins. Hinge body (1) comprises a sitting surface (11) having a wide face and preferably a rounded cross section; a leg (14) extending upward there from; a pin-damper housing (12) preferably having a rounded cross section extending on this leg and pin and damper are being recessed inside the hole therein; one or more protrusion slots (13) at the ends of the hole inside this housing.

Figure 2:
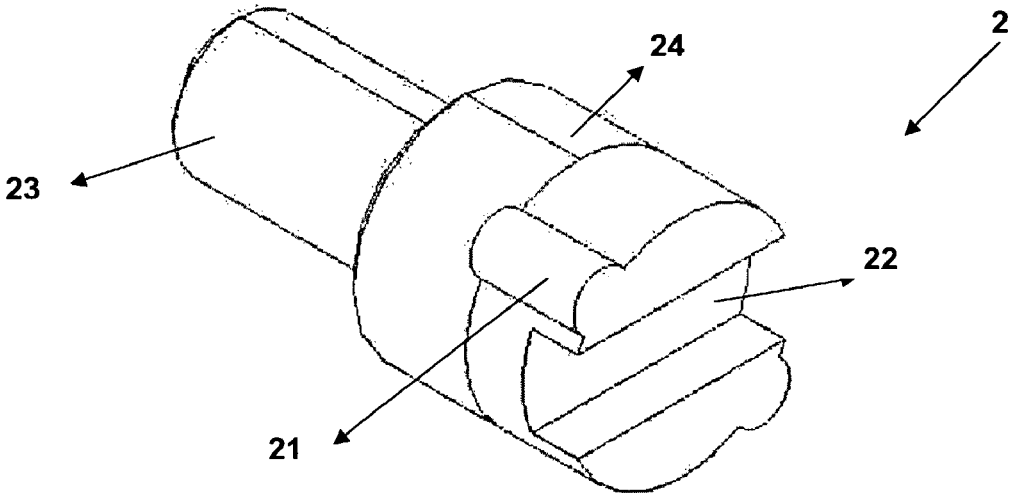
FIG. 2 is a perspective view of the pin.

Pin (2) shown in FIG. 2 is a part directly connected to lower and upper toilet covers, recessed in the hinge body (1) without any turning and attached to the damper (3) at one end. Pin (2) comprises a pin shaft (23) having a rounded cross section connected to lower and upper toilet covers; a pin body (24) having a rounded cross section coaxial with the pin shaft (23) at one end of this shaft and that could be received in the hole inside the hinge body (1); one or more pin fingers (21) in a protrusion form being at one end of this body (24) and on the arched lateral surface and that could be received in the protrusion slots (13); a pin channel (22) on the flat surface of the pin body (24) and being parallel to this surface preferably in tetragonal cross section at the side where the pin protrusions are located.

Figure 3:
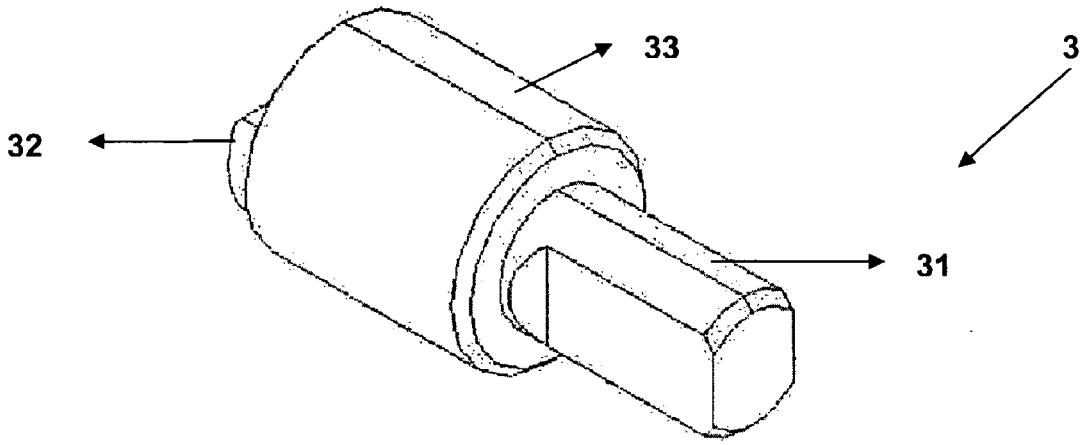
FIG. 3 is a perspective view of the damper.

Damper (3) shown in FIG. 3 is a part directly connected to lower and upper toilet covers, recessed in the hinge body (1) and attached to the pin (2) at one end. Damper (3) comprises a damper fixing protrusion (32) which could be tightly located in the pin channel (22), a damper body (33) which is rounded in cross section and a damper shaft (31) which is rounded in cross section having both sides flattened. The axis of the damper shaft (31) coincides with the axis of the damper body (33). Damper fixing protrusion (32) is on the flat surface of the damper body (33) and parallel to this surface and preferably having a rounded cross section. Damper fixing protrusion (32) and the damper body (33) have an integrated structure and made of elastic material to provide slow closure. Damper shaft (31) is tightly recessed in the damper body (33) at one side. The axis of the damper shaft (31) coincides with the axis of the damper body (33). Although the damper shaft (31) is tightly recessed in the damper body (33), since the damper body (33) is made of elastic material and the damper shaft is made of rigid material, damper shaft (31) could be slowly pivoted in the damper body (33) with a friction. This frictional slow pivoting direction is one-way. Damper shaft (31) could be pivoted in the damper body (33) at the other direction more easily and quickly.

Figure 4:
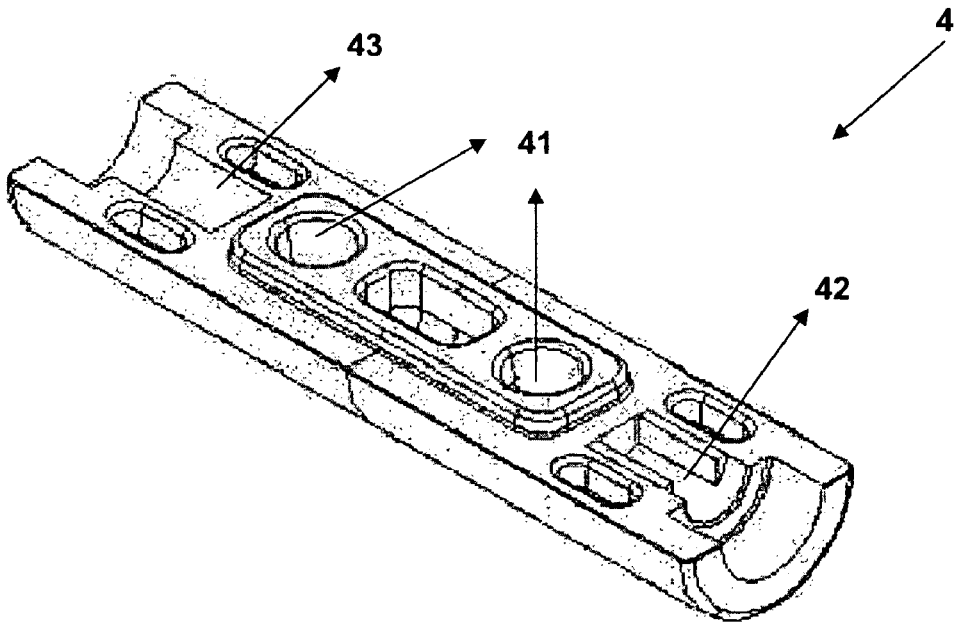
FIG. 4 is a perspective view of the body cover.

Body cover (4) shown in FIG. 4 is a part connected to the damper (3), pin (2) and either lower or upper toilet cover. Body cover (4) has an elongated cylindrical body preferably in rounded cross section and comprises one or more hole for body cover screw (41) in order to connect it to the lower and upper toilet covers, damper placement housing (42) of body cover to recess the damper (3) at one end and pin placement housing (43) of body cover to recess the pin (2) at the other end. Linear axis of damper placement housing (42) of body cover and pin placement housing (43) of body cover coincide with the linear axis of the body cover (4). Damper placement housing (42) of body cover is in the form of a half gap with a rounded cross section having both sides flattened such that the damper shaft (31) is fitted. Pin placement housing (43) of body cover is in the form of a half gap with a rounded cross section such that the pin shaft (23) is fitted and freely pivoted.

Figure 5:
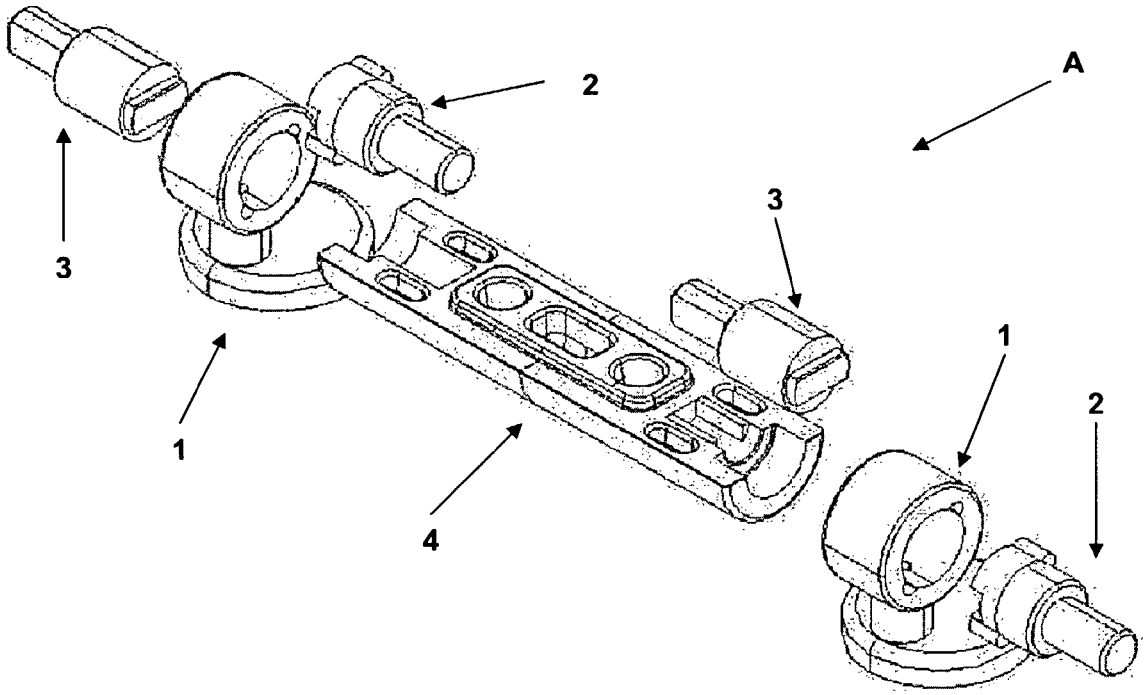
FIG. 5 is a perspective view of the slow closure mechanism, excluding covers, before mounting.
Figure 6:
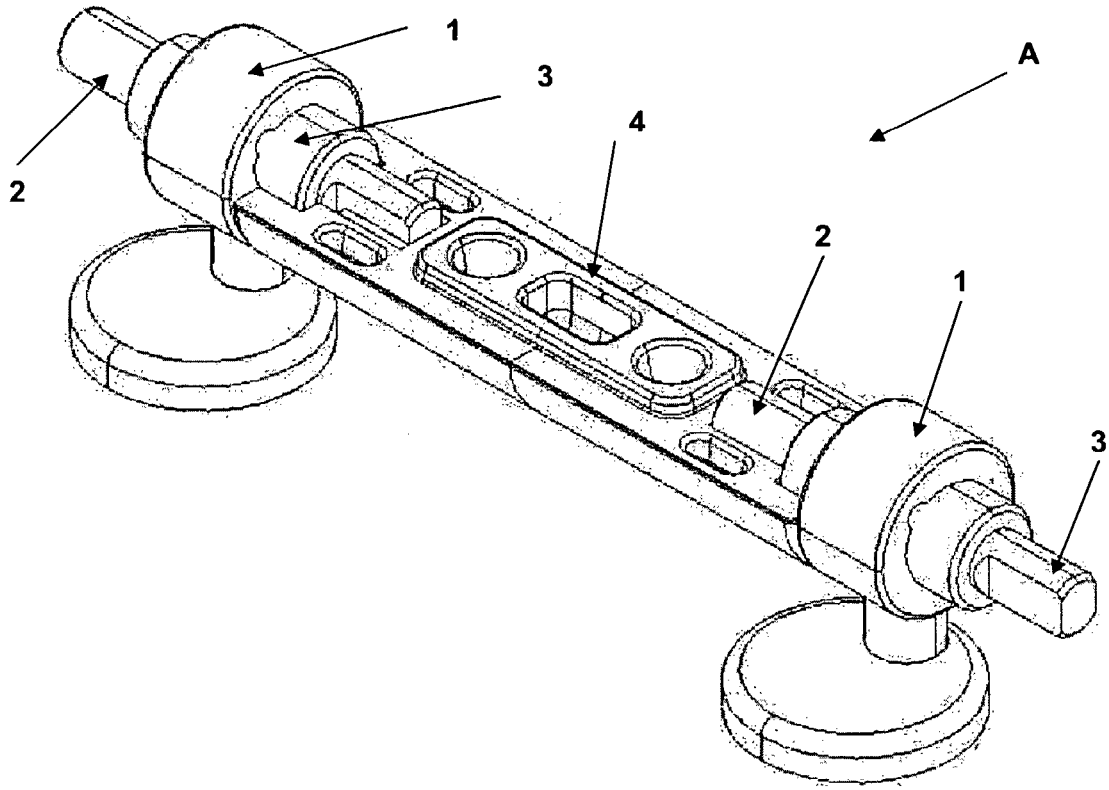
FIG. 6 is a perspective view of the slow closure mechanism, excluding covers, after mounting.
Figure 7:
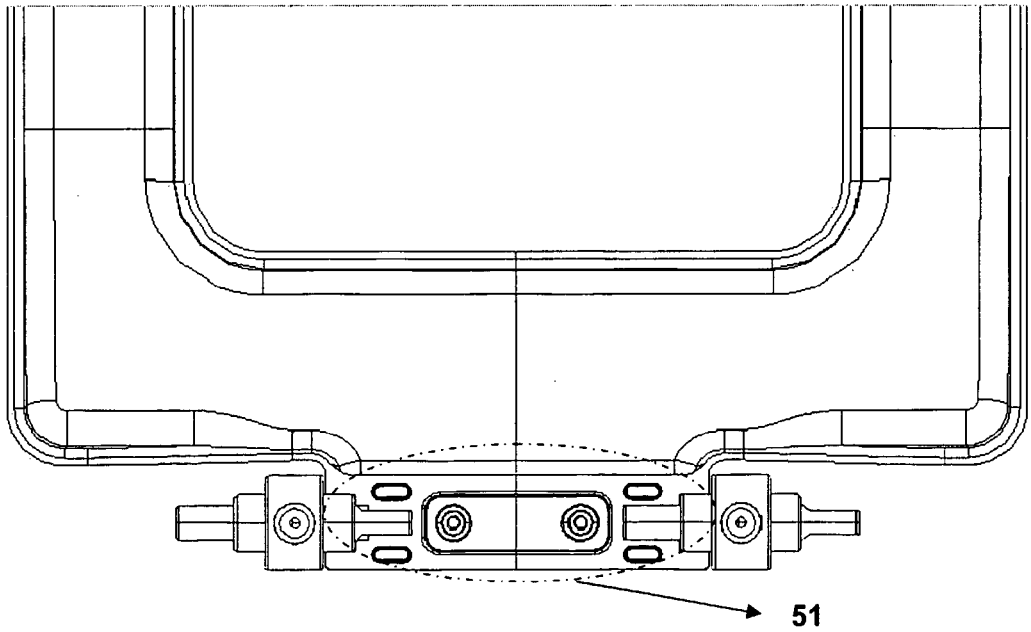
FIG. 7 is a bottom view of an example of the toilet cover.
Figure 8:
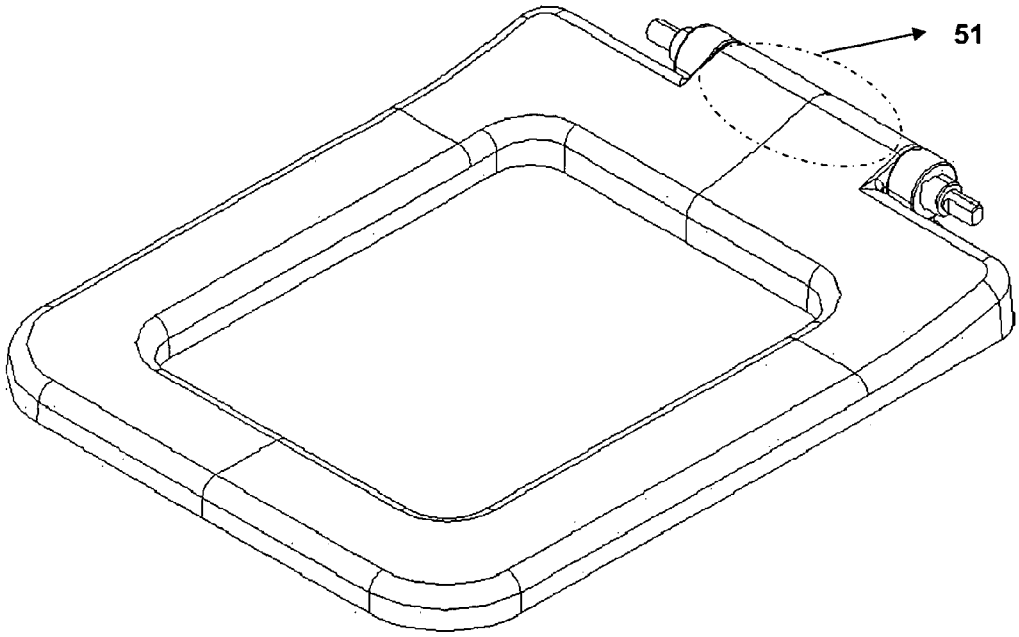
FIG. 8 is a top perspective view of the cover shown in FIG. 7.
Figure 9:
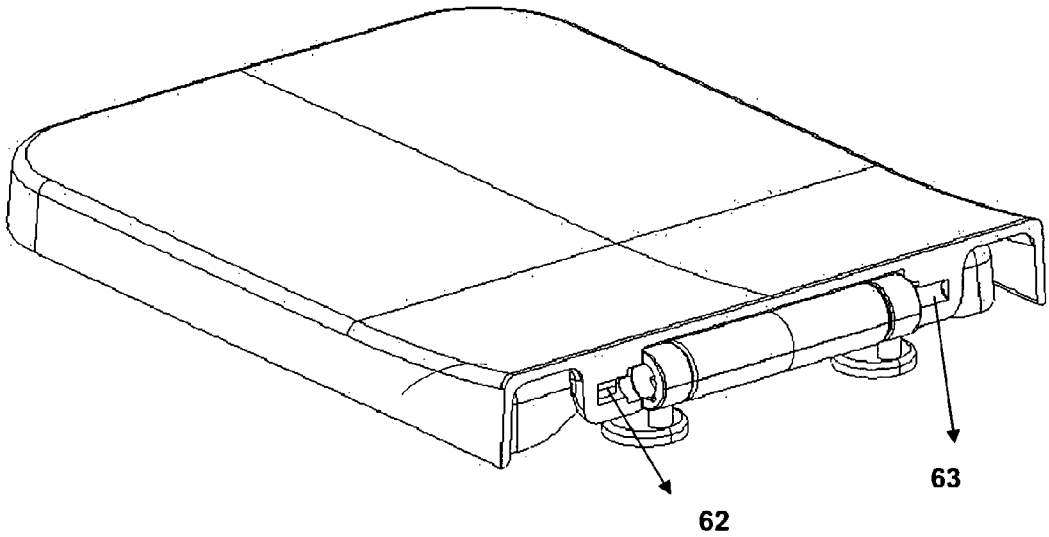
FIG. 9 is a rear perspective view of an example of the toilet cover.

Slow closure mechanism (A) for toilet covers given as before mounting view in FIG. 5 is shown as after mounting view in FIG. 6, excluding toilet covers. In slow closure mechanism (A) for toilet covers shown as after mounting in FIG. 6, two hinge bodies (1) are connected to the mounting holes on the toilet (not shown in Figure). Pins (2) are attached to each two hinge bodies (1) such that they are on the same side relative to the hinge body (1). Pins (2) are located in the holes inside the hinge body (1) such that pin protrusions (21) remain in the protrusion slots (13). By means of this, pins (2) are prevented to be pivoted relative to the hinge body (1). In this mounting, pin shafts (23) outwardly extend from the hinge bodies (1) in same direction. Also, dampers (3) are attached to each two hinge bodies (1) such that they are on the same side relative to the hinge body (1) and on the other side relative to the pins (2). In this connection design, damper fixing protrusion (32) is tightly located in the pin channel (22) and damper shaft (31) remains outside of the hinge body (1). Therefore, one damper shaft (31) and one pin shaft (23) are between two hinge bodies (1) such that they extend to each other. Also, one damper shaft (31) and one pin shaft (23) extend from the hinge body (1) and they extend in opposite directions to each other. Body cover (4) is connected between the hinge bodies (1) wherein it houses damper placement housing (42) of body cover to recess the damper (3) at one end and pin placement housing (43) of body cover to recess the pin (2) at the other end. On the body cover (4), hole for screw (41) of body cover is used for connection to lower or upper toilet covers (not shown in Figure). Rear portions of lower or upper toilet cover are shaped as body cover (1) at the side of hinge body (1). One example of body cover form (51) on the toilet cover is shown in FIG. 7 and FIG. 8. This example form (51) shown in FIG. 7 and FIG. 8 is given for lower cover, however same structure could be used for upper cover. Therefore, upper or lower toilet cover is attached to the body cover (4) and then upper or lower toilet cover attached to the body cover (4) is recessed between hinge bodies. Other cover is connected to the mechanism outside the hinge bodies (1). On the other cover mentioned, there is a pin housing of cover (63) freely pivotable relative to the cover pin shaft (23) and a damper housing of cover (62) pivotal with the damper shaft (31) of same cover. These recesses are shown in FIG. 9. Pin housing of cover (63) has an identical form with the pin placement housing (43) of body cover and likely damper housing of cover (62) has an identical form with the damper placement housing (42) of body cover.

When lower and upper covers are attached to the slow closure mechanism (A), one pin (2) and one damper (3) are attached to lower cover and at the same time one pin (2) and one damper (3) are attached to upper cover. Dampers (3) provide slow and controlled closure of the covers by applying brake to the covers in one and downward direction. Only function of the pins is recessing of the covers to allow freely pivoting thereon. Thus, braking function is done only by dampers (3).

Damper pins (31) are tightly engaged in damper sitting recesses in lower and upper cover. Since the damper shaft (31) has a cylindrical shape that is flattened at both ends and damper sitting recesses on lower and upper cover are in identical form with damper shaft (31), damper shafts (31) pivot together with lower and upper cover. Dampers (3) used herein exhibit resistance during pivoting of damper shafts (31) in one-way and only downwards direction. In this way, slow closure of lower and upper toilet covers is achieved. As the covers are lifted upwards, covers could be lifted by the user easily since damper shafts (31) are freely pivoted in damper body (33). Since dampers control lower cover and upper cover separately, namely they work independently from each other, lower and upper cover could also be closed separately in a slow manner.

Preferred slow closure mechanism (A) for toilet covers above is not intended to limit the protection scope of the invention. In view of the described knowledge by the invention, all modifications on this preferred slow closure mechanism (A) should be interpreted in the protection scope of the invention.

The invention claimed is:

1. A slow closure mechanism (A) provides slow closure of upper and lower toilet covers comprising:

a hinge body (1), used to connect said mechanism (A) to the toilet covers, comprising a sitting surface (11) having a wide face, a leg (14) extending upward from this surface (11), a pin-damper housing (12) extending on this leg (14), a damper (3), directly connected to lower and upper toilet covers, recessed inside a hole of the pin-damper housing (12), and said damper (3) comprising a damper shaft (31) which is rounded in cross section having both sides flattened, a damper body (33) which is rounded in cross section, a damper fixing protrusion (32) which could be tightly located in a pin channel (22), being on the flat surface of the damper body (33) and parallel to this surface and having a rectangular cross section, a pin (2), directly connected to the lower and upper toilet covers, recessed inside the hole of the pin-damper housing (12) and attached to the damper (3) at one end, a body cover (4) connected to the damper (3), the pin (2) and the lower or upper toilet cover, having a semi cylindrical body and comprising one or more holes (41) for a body cover screw for connection to the lower or upper toilet cover, a pin placement housing (43) with a semi circular cross section such that a pin shaft (23) is fitted and freely pivoted and a damper placement housing (42) where the damper shaft (31) is fitted, and said mechanism (A) is characterized in that one or more protrusion slots (13) are extending through the inner surface of the hole inside the housing (12) such that pin protrusions (21), on the outer circular surface of the pin (2) which is recessed not to make a pivoting motion.

2. The slow closure mechanism (A) according to claim 1 wherein said pin (2) comprises the pin shaft (23) having a circular cross section connected to the lower and upper toilet covers; a pin body (24) having a circular cross section coaxial with the pin shaft (23) at one end of this shaft (23) and located in the hole of the pin-damper housing (12); the pin protrusions (21) being at one end of this body (24) and on the outer circular surface of the pin body (24) and said protrusions (21) mounted in the protrusion slots (13); the pin channel (22), with a rectangular cross section, on the flat surface of the pin body (24) and being parallel to this surface, at the side where the pin protrusions (21) are located.

3. The slow closure mechanism (A) according to claim 1 wherein, said damper placement housing (42) has a semi circular cross section having both sides flattened such that the damper shaft (31) is fitted.

4. A mounting method of the slow closure mechanism (A) for toilet covers according to any one of the preceding claims comprises the steps of:

connecting two hinge bodies (1) to the mounting holes on the toilet, attaching said pin (2) to each pin-damper housing (12) such that they are on the same side relative to the hinge bodies (1), locating the pins (2) in the hole of the pin-damper housing (12) such that the pin protrusions (21) remain in the protrusion slots (13), to prevent pivoting motion of the pins (2) relative to hinge bodies (1) and providing pin shafts (23) outwardly extend from the hinge bodies (1) in same direction, attaching the damper (3) to each pin damper housing (12) such that they are on the same side relative to the hinge bodies (1) and on the other side relative to the pins (2), tightly locating damper fixing protrusions (32) in the pin channels (22) and damper shafts (31) remain outside relative to the hinge bodies (1), connecting the body cover (4) between the hinge bodies (1) providing damper placement housing (42) to recess the damper (3) at one end; and pin placement housing (43) to recess the pin (2) at the other end, using holes (41) for screw connection of body cover to the lower or upper toilet covers.

* * * * *